United States Patent [19]

Selas

[11] 4,179,676

[45] Dec. 18, 1979

[54] TIME DELAY RELAY MOVEMENT

[75] Inventor: George J. Selas, Milwaukee, Wis.

[73] Assignee: Allen-Bradley Company, Milwaukee, Wis.

[21] Appl. No.: 895,547

[22] Filed: Apr. 12, 1978

[51] Int. Cl.[2] ..... H01H 7/00; H01H 43/02; H01H 7/03

[52] U.S. Cl. ..... 335/59; 74/3.5; 200/34; 335/61; 335/64

[58] Field of Search ..... 335/59, 60, 61, 62, 335/63, 64, 65, 66, 67; 200/34; 74/3.5

[56] References Cited

U.S. PATENT DOCUMENTS

| | | | |
|---|---|---|---|
| 2,840,663 | 6/1958 | Horn | 335/61 X |
| 3,249,716 | 5/1966 | Haydu et al. | 335/59 |
| 4,024,482 | 5/1977 | Lisnay et al. | 335/59 X |

*Primary Examiner*—Fred L. Braun
*Attorney, Agent, or Firm*—Quarles & Brady

[57] ABSTRACT

An improved movement for a time delay relay cooperates with an electromagnet and a timer to provide either "On Delay" or "Off Delay" operation of the relay contacts. The movement has an elongated operating plunger that is movable in forward and backward strokes, a latch, and a contact actuator coupling the latch to the relay contacts. A pair of springs are disposed in a spring cage formed in the actuator and at least one spring-compressing flange is carried by the plunger and disposed between the springs. In the on delay mode of operation, one spring is loaded against the actuator upon a forward stroke of the plunger. In the off delay mode of operation, the other spring is loaded against the actuator upon a backward stroke of the plunger. The latch is restrained upon the movement of the plunger to load one of the springs, and is subsequently released from its restraint after a time delay to operate the relay contacts with spring action.

16 Claims, 12 Drawing Figures

TIME DELAY RELAY MOVEMENT

BACKGROUND OF THE INVENTION (a) Field of the Invention

The invention relates to timing relays that provide a delayed contact actuation, and in particular to improvements in a relay movement that cooperates with an electromagnet and a timer to actuate switch contacts. Timing relays are used in electrical motor control circuits and automated manufacturing systems to operate one or more switches with a time delay following energizing or deenergizing of the electromagnet.

(b) Description of the Prior Art

Timing relays may be operated in two modes, "On Delay" and "Off Delay." Some devices can operate in either of these two modes, while other devices operate in but one of the modes. In the on delay mode, the time delay in actuating a set of switch contacts occurs after the energization of the associated electromagnet. In the off delay mode, the time delay occurs upon the deenergization of the electromagnet, so that the return of the delayed action switch contacts to their normal state, either normally open or normally closed, lags movement of the electromagnet. The construction and operation of a basic multimode timing relay are shown and described in Haydu et al, U.S. Pat. No. 3,249,716.

In timing relays as shown in said U.S. Pat. No. 3,249,716, the relay movement that actuates the time delayed switch contacts is responsive to the action of an electromagnet, and also includes a set of levers and other mechanical elements to reset and respond to an advancing member of a timer. The timer may be of the expanding bellows, pneumatic type in which the rate of bellows expansion may be set to provide a control over the time delay period. The advancing member of the timer can be attached to the bellows to move therewith, and the relay movement cooperates with this advancing member to produce the time delayed switch actuation. In such multimode devices, the location of the advancing member relative to certain elements in the relay movement determines the mode of operation, i.e., either on delay or off delay.

The relay movement includes springs that are normally compressed for the purpose of actuating the switch contacts with a rapid movement when the springs are released. Upon energization of the electromagnet, and with the timer member located for on delay operation, the timer member is caused to advance to actuate the relay movement. The relay movement then releases the springs to operate the time delayed switch contacts. When the advanceable timer member is located to operate the relay movement in the off delay mode, a like result is obtained upon a deenergization of the electromagnet. In this structure the actuating springs that open and close the time delayed switch contacts may work against one another, such that one spring is loaded by the unloading of the other spring. It would be desirable to eliminate this opposed relationship between the actuating springs.

Time delay relay movements typically comprise a number of complex levers, catches, springs and other mechanical elements that are subject to wear. They have not achieved an optimum of efficient and effective operation of their parts, and accordingly prior art devices have components and operating motions that can be simplified, and better balanced against one another to obtain improved performance.

SUMMARY OF THE INVENTION

The present invention provides a time delayed relay movement that is responsive to both an electromagnet and a timer and that has its component parts arranged along an operating plunger moved by the electromagnet, including spring means loaded upon plunger movement and spring restraining means having a lost motion connection relative to the plunger that releases the spring means in response to the timer to effect a spring actuated, time delayed contact movement.

More specifically, the invention contemplates a relay movement that actuates switch contacts and includes an elongated operating plunger longitudinally movable in forward and backward strokes, and a contact actuator that is reciprocably movable along said plunger and adapted to be coupled to said switch contacts to operate the same. The contact actuator has a pair of spaced spring stops disposed longitudinally of said plunger with a pair of springs disposed therebetween. The plunger carries spring-stressing means between the springs for loading one of the springs to apply a force against one of the spring stops on a forward stroke of the plunger, and for loading the other of the springs to apply a force against the other of the spring stops on a backward stroke of the plunger. The relay movement also includes catch means and a latch coupled to said actuator for movement therewith, the latch being restricted by the catch means upon a movement of the plunger to load one of the springs against the actuator. A timer is adapted to move the catch means after a time delay from the movement of the plunger, thereby releasing the latch to actuate the switch contacts with spring action.

It is an object of the invention to reduce the number of spring-loading movements in actuating time delayed switch contacts to a single loading of either an on delay spring or an off delay spring.

It is another object of the invention to minimize the number of springs included in a relay movement for on delay and off delay operation.

It is another object of the invention to provide sleeves to maintain the springs in a seated position within the relay movement whether the on delay and off delay springs are being stressed or not.

It is another object of the invention to provide a latch, for coupling the movements of a timer output member and the contact actuator, that moves against the catch means with less force than the force imparted to it by the on delay and off delay springs, thereby preventing wear on the latch and the catch means.

It is another object of the invention to replace the more complex latch mechanisms of the prior art with an integral latch that has a lost motion coupling connection with the actuator to transmit longitudinal motion to the actuator along the plunger.

It is another object of the invention to minimize the spring load to be overcome by the electromagnet upon energization by providing a lost motion connection between the plunger and the spring-stressing means.

It is another object of the invention to provide a relay movement in a single assembly which can be inserted and removed from a housing without the escape of loose parts.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is therefore made to the claims herein for interpreting the scope of the invention.

DESCRIPTION OF THE PREFERRED EMBODIMENT

Figure 1:
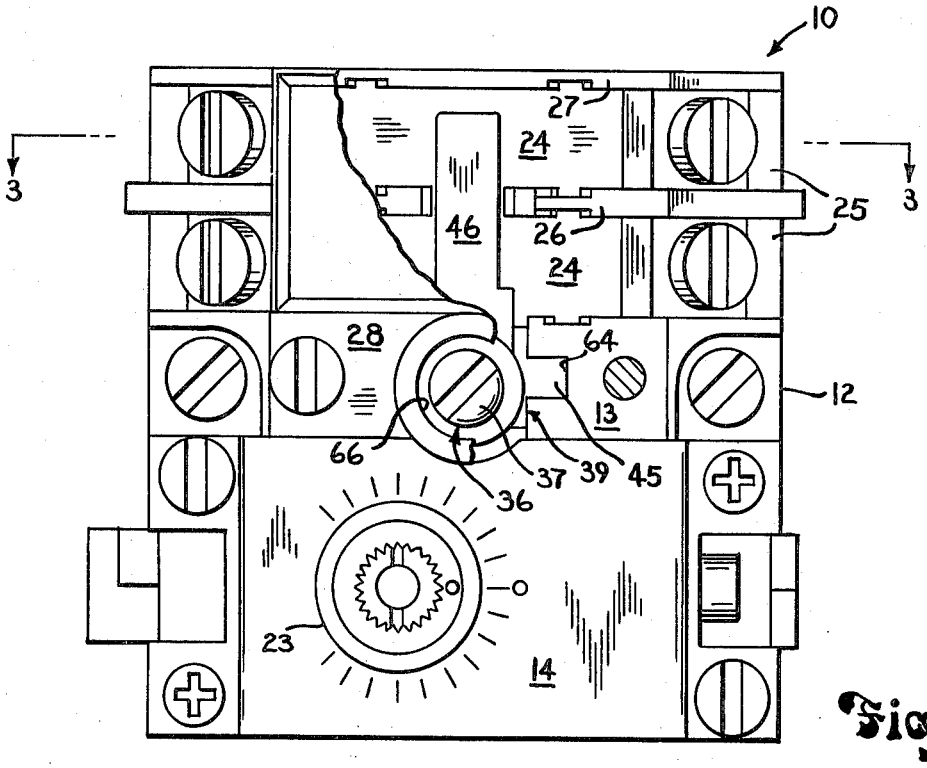
FIG. 1 is a top view of a time delay relay embodying the present invention with part of a top cover broken away to show switch cartridges and part of the contact actuator.
Figure 2:
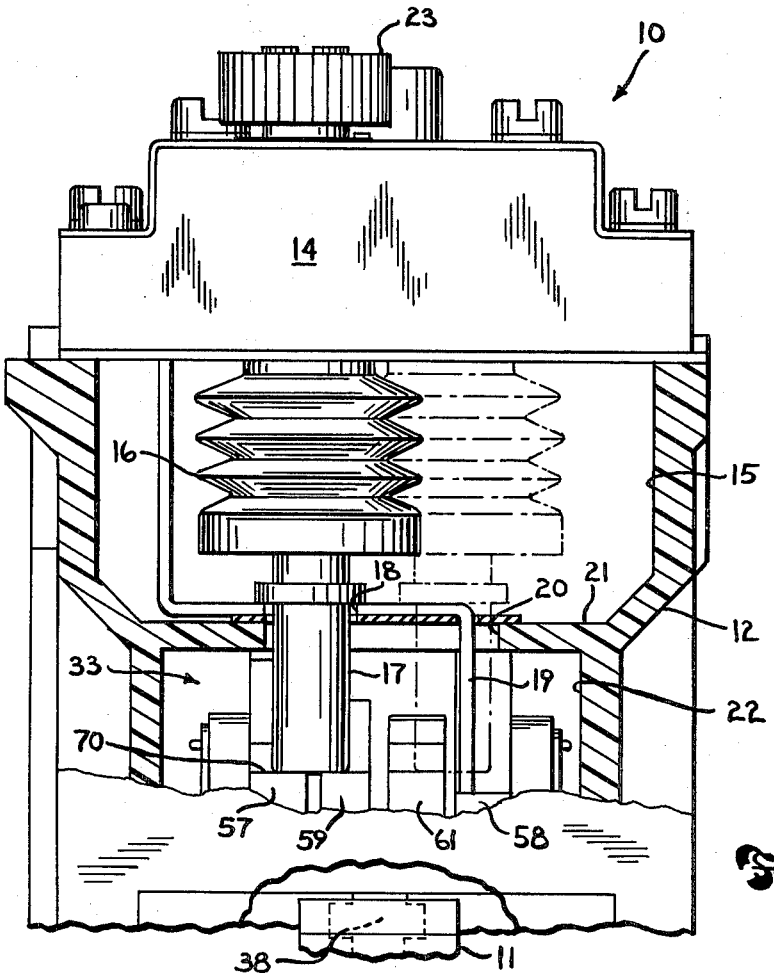
FIG. 2 is a side elevation view of the upper portion of the time delay relay of FIG. 1 with part of a side wall broken away to show a timer.
Figure 3:
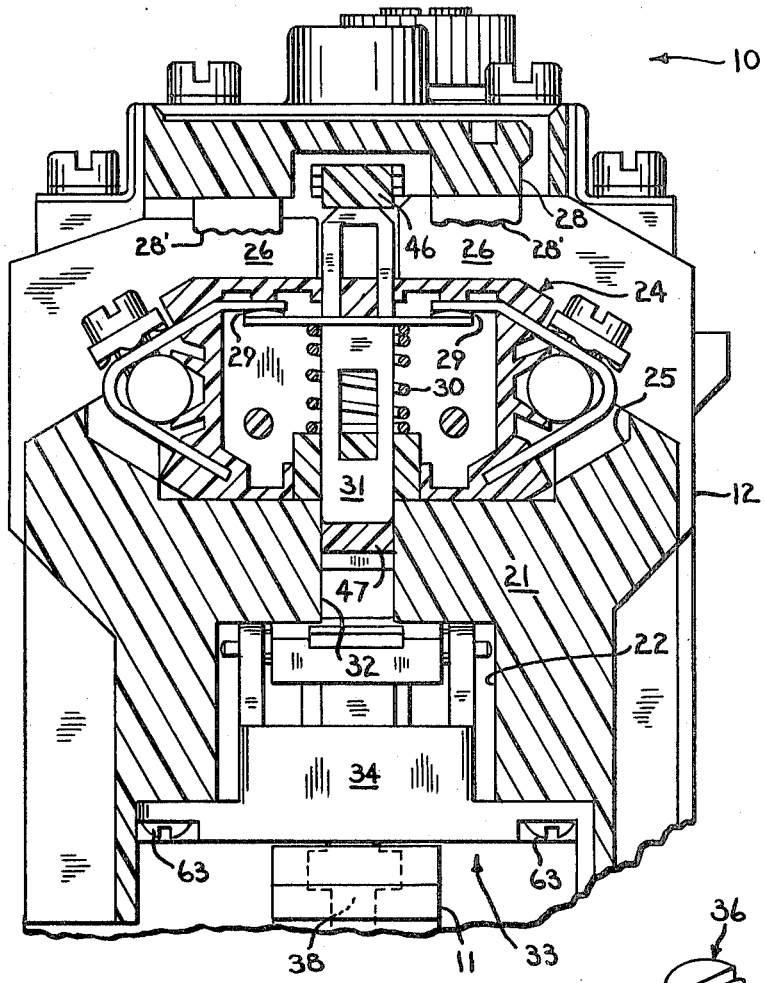
FIG. 3 is a sectional view taken in the plane indicated by line 3—3 in FIG. 1 to show a set of normally closed switch contacts and a mechanism for opening and closing the switch contacts.

FIGS. 1-3 show a time delay relay 10 that embodies the present invention. The relay 10 is adapted to be mounted on the top of an associated electromagnetic contactor, and it is connected by a coupling 11, fragmentarily shown in FIGS. 2 and 3, to the armature of the electromagnet. The electromagnetic contactor is not shown in the drawings, for it may be of a type well known in the art, in which the electromagnet has an armature that moves upon the energization and deenergization of an associated coil to operate switch contacts that are a part of the contactor. The relay contacts shown in the drawings as a part of the present invention supplement the switch contacts of the contactor, and will be time delayed with respect thereto.

Referring particularly to FIG. 1, the time delay relay 10 has a housing 12 of insulating material molded in a complex configuration. The housing 12 is divided into two sections by a central longitudinal rib 13. On one side of the central rib 13, a pneumatic timer 14 is mounted on top of a timer compartment 15, as seen in FIG. 2, and has an expandable bellows 16 that depends into the timer compartment 15. Depending from the bellows 16 is an output member 17 in the form of a short cylindrical shaft. The member 17 extends through a guide opening 18 in the horizontal portion of a hold-down member 19. The member 19 is in the form of a bent plate, depending from the main body of the timer 14, that terminates in a vertical lower end. Both the output member 17 and the vertical end of the hold-down member 19 extend through an opening 20 in a horizontal partition 21 which separates the timer compartment 15 from a chamber 22 therebelow.

The pneumatic timer 14 is preferably of the type more fully described in copending application Ser. No. 895,728 of George J. Selas entitled "Adjustment for Pneumatic Timer" and filed concurrently herewith. Within the timer 14 a needle valve, which is not shown, controls the expansion of the bellows 16 by controlling the entry of air into the bellows 16. The needle valve is adjusted by turning a knob 23 on top of the timer 14 to select a rate of expansion for the bellows 16. As the bellows 16 expands, the output member 17 advances along a path of travel over the selected time delay period.

Referring again to FIG. 1, a pair of switch cartridges 24 are disposed in switch compartments 25 formed alongside the timer compartment 15 and separated therefrom by the central rib 13. The switch compartments 25 are formed by the central rib 13, an intermediate rib 26 having a vertical gap down its center, and a side wall 27 of the housing 12, which are all parallel and spaced apart from one another. The horizontal partition 21 forms a flooring for the switch compartments 25, as seen in FIG. 3. The switch cartridges 24 are held in the switch compartments 25 by studs 28′ depending from the underside of the housing cover 28, which have been broken off in FIG. 3 to show other features of the housing 12. The switch cartridge 24 shown in FIG. 3 has switch contacts 29 that are held in a normally closed position by a switch contact spring 30. The switch contacts 29 are operated by moving a slidable switch stem 31 longitudinally through the switch compartment 25. The lower end of the switch stem 31 is received in a passageway 32 that passes through the partition 21 from the switch compartments 25 to the chamber 22. The switch cartridge 24 may be operated with the switch contacts 29 normally open by turning the cartridge 24 upside down in the switch compartment 25, with the other end of the switch stem 31 then being received in the passageway 32.

Figure 4:
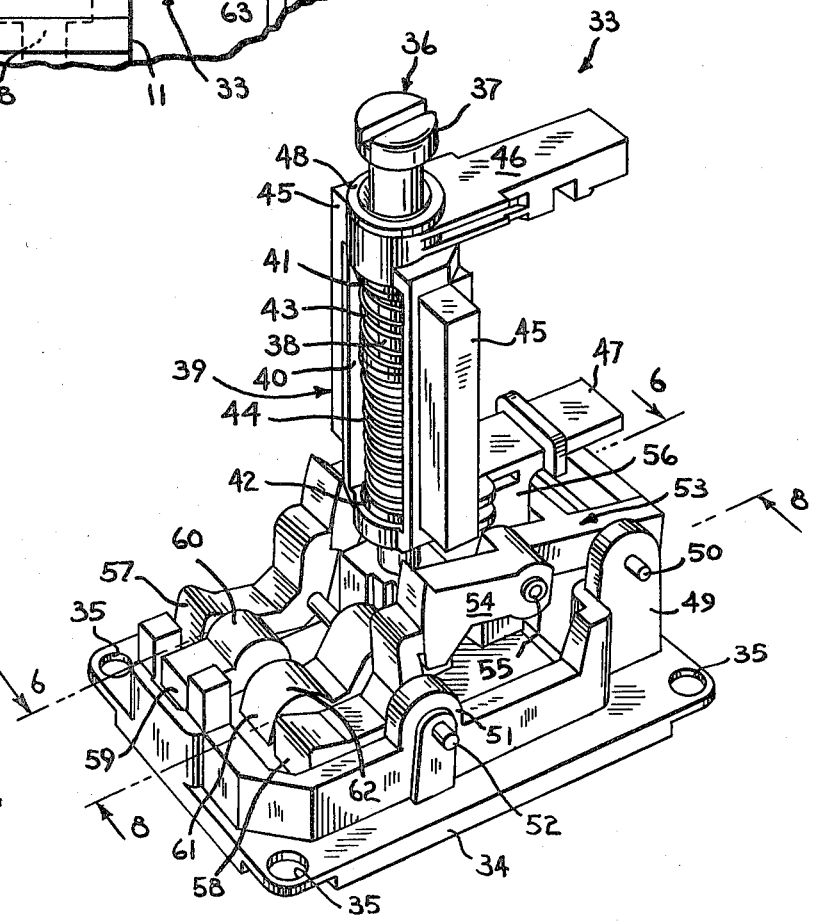
FIG. 4 is a perspective view of a relay movement assembly forming a part of the time delay relay of FIG. 1.

In FIG. 4 a relay movement 33 for the time delay relay 10 is shown as a complete assembly ready for insertion and mounting in the housing 12. A base 34 of the movement 33 has apertures 35 in its four corners provided for bolting the assembly into place. The relay movement 33 is built around an elongated plunger 36 comprised of a slotted head 37 at its upper end and a cylindrical shaft 38 that extends downward through the base 34 for connection with the magnet armature coupling 11. A contact actuator 39 has an elongated, vertical, box-shaped body that extends along three sides of the shaft 38. The upper and lower ends of the box-shaped body encircle the shaft 38 to mount the contact actuator 39 on the plunger 36 with a sliding fit that permits reciprocating movement therealong. The hollow interior of the box-shaped body of the contact actuator 39 forms a spring cage 40 that is open along one vertical side. The upper and lower ends of the interior of the spring cage 40 form a pair of spring stops 41, 42 that encircle the shaft 38, and a pair of springs 43, 44 are inserted end to end in the spring cage 40 between the stops 41, 42.

Longitudinal ribs 45 are formed on the exterior of opposite sides of the contact actuator 39. Extending horizontally from the body of the contact actuator 39, and radially outward from the shaft 38, are a pair of vertically spaced links 46, 47. The upper link 46 is pivotable about the vertical axis of the plunger 36. A bearing sleeve 48 in the link 46 has a flange forced down upon the top of the link 46 to prevent it from pivoting too easily, the bearing sleeve 48 still permitting the contact actuator 39 to slide easily along the shaft 38.

Still referring to FIG. 4, the parts of the relay movement 33 that cooperate with the timer output member 17 and restrict the movement of the contact actuator 39 are arranged on the base 34 around the plunger 36. The base 34 has a first pair of spaced supports 49 with a pivot pin 50 therebetween located on one side of the plunger 36, and a second pair of spaced supports 51 holding a pivot pin 52 therebetween on the other side of the plunger 36. A latch 53 is pivotally mounted on the first pivot pin 50 and has a pair of arms 54 extending toward the second pivot pin 52 and just to the other side of the plunger 36. The latch 53 is coupled intermediate its ends with a coupling pin 55 to an actuator stop member 56 depending from the actuator link 47 nearest the base 34, as seen more clearly in FIG. 6. Again, referring to FIG. 4, an on delay catch 57 and an off delay catch 58 are pivotally mounted on the second pivot pin 52 and biased for rotation toward a position restricting the movement of the latch 53 about its pivot. An on delay finger 59 is fastened on the plunger shaft 38 to move therewith, and it has an upwardly facing, arcuate pad 60 adapted to engage the timer output member 17. An off delay finger 61 is pivotally mounted on the second pivot pin 52 and also has an upwardly facing pad 62 adapted to engage the timer output member 17. Further structural details of these parts will be described with the operation of the relay movement 33.

As seen in FIG. 3, the relay movement 33 can be inserted into the housing 12 from the bottom. This insertion of the movement 33 is made prior to placement of the switch cartridges into the compartments 25. The two actuator links 46, 47 are moved upward through the passageway 32, and the upper link 46 passes through the central gap of the rib 26. The links are then in the positions shown in FIG. 3, and together with the rest of the contact actuator 39 are movable in downward and upward strokes in response to the springs 43, 44, in a manner to be described. The bottom portion of the movement 33 comprising the several parts mounted on the pins 50 and 52 are housed in the chamber 22, as seen in FIG. 2. Mounting screws 63, seen in FIG. 3, extend through the base apertures 35 to hold the relay movement in place.

Referring to FIG. 1, the body of the contact actuator 39 fits within a vertical, central opening in the central rib 13. In this position, each of the longitudinal ribs 45 is snugly received in sliding engagement with a mating mutual groove 64 formed in the rib 13. The contact actuator 39 is thus guided for vertical movement and restrained from rotation as it slides along the plunger 36.

When the cover 28 is removed, the upper link 46 of the contact actuator 39 can be raised slightly from its position shown in FIG. 3, and pivoted ninety degrees about the plunger 36 to overlie the rib 13. The entry to each of the switch compartments 25 is now free of any overhanging obstruction, and the switch cartridges 24 can now be dropped into place. Upon inserting the cartridges, the upper link 46 is moved back into position, as shown in FIGS. 1 and 3, and the cover 28 is attached to the relay housing 12. Now, each of the switch stems 31 is entrapped snugly between the upper and lower links 46, 47, so that vertical movement of actuator 39 will effect contact actuation.

With the relay movement 33 mounted in the housing 12, the plunger 36 can be connected to the coupling 11. The lower end of the plunger 36 engages the coupling 11 with a threaded connection, which is not shown. The slotted plunger head 37, which is situated within a port 66 formed in the cover 28, as shown in FIG. 1, is rotated with the end of a common screwdriver to secure the connection.

The mode of operation, either on delay or off delay, is determined by the location of the timer output member 17 relative to the relay movement 33. As seen in FIG. 2, the timer output member 17 is located for the on delay mode of operation, in which it advances along a path toward the on delay catch 57 and the on delay finger 59 that are on the left. The timer hold-down member 19 contacts the off delay catch 58 on the right to hold it inoperable. The timer 14 can be rotated 180 degrees into a reverse position, such as shown in phantom in FIG. 2, for the off delay mode of operation. Then, the timer output member 17 advances along a path toward the off delay finger 61 and the off delay catch 58 located on the right. In the off delay mode the timer hold-down member 19 contacts the on delay catch 57 on the left, to hold it inoperable.

Referring to FIGS. 5–8, the operation of the relay movement 33 in either of its two modes is initiated by the plunger 36, which moves longitudinally in alternate directions upon the energization and deenergization of the electromagnet coupled to it. The plunger 36 moves in a forward stroke toward the base 34 upon the energization of the relay electromagnet and it moves in a backward stroke away from the base 34 upon the deenergization of the electromagnet.

Figure 5:
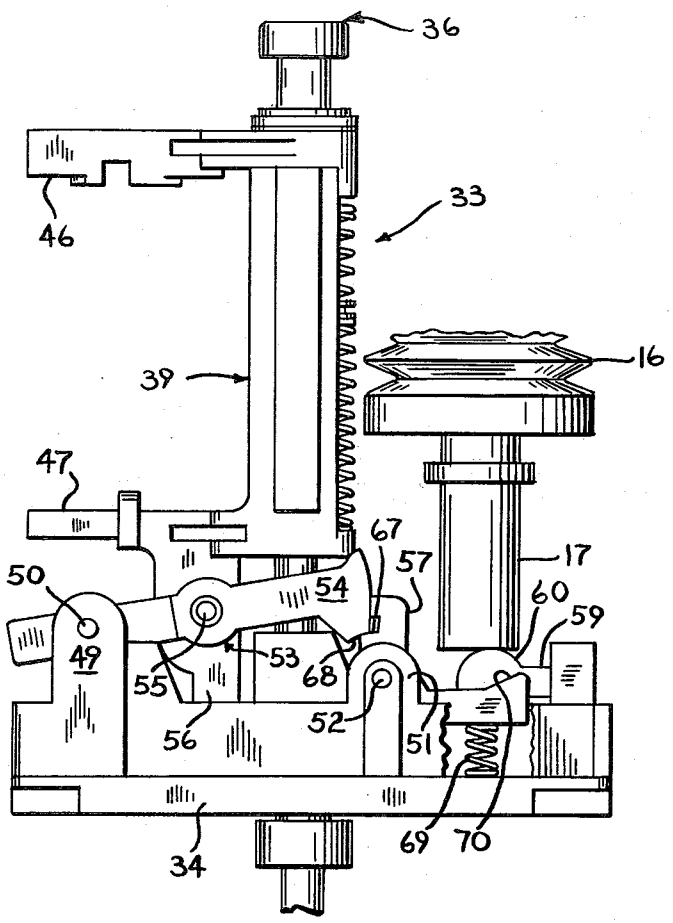
FIG. 5 is a side elevation view of the relay movement assembly of FIG. 4, and the bottom part of the timer, in the on delay mode of operation.

In FIG. 5 the plunger 36 is shown immediately before a forward stroke, and with the timer output member 17 positioned for operation in the on delay mode. The on delay finger 59 is held by the plunger 36 in a raised position with its pad 60 holding the timer output member 17 in its corresponding upper position with the bellows 16 collapsed. This blocks the downward advance of the timer output member 17. The latch 53 has a shoulder 68 at the free end of one arm 54 held in an upper position by the on delay catch 57. Since the latch 53 is coupled to the contact actuator 39 by the pin 55, the actuator 39 is similarly in a raised position. The actuator links 46, 47 then hold the switch stems 31 in their raised position. (Stems 31 are not shown in FIGS. 5–8 for reasons of clarity.)

Now, upon the energization of the associated electromagnet, which is the "on" condition, the coupling 11 and plunger 36 are pulled downward, to effect a forward stroke of the plunger 36. Through the medium of the springs 43, 44 in the spring cage 40 the contact actuator 39 is urged to follow the forward stroke of the plunger 36. This causes the latch 53, which is coupled to the contact actuator stop member 56 to be similarly urged around its pivot 50 toward the base 34 on the forward stroke of the plunger 36. The movement of the latch 53 is restricted, however, by the on delay catch 57, and more specifically, by a detent 67 that engages the shoulder 68 formed on the latch arm 54. The on delay catch 57 is biased into its restricting position by a bias spring 69 located on the base 34 under a trigger end 70 that is in the path of advance of the timer output member 17. The restriction of the latch 53 prohibits the movement of the contact actuator 39, but not the movement of the plunger 36.

Figure 6:
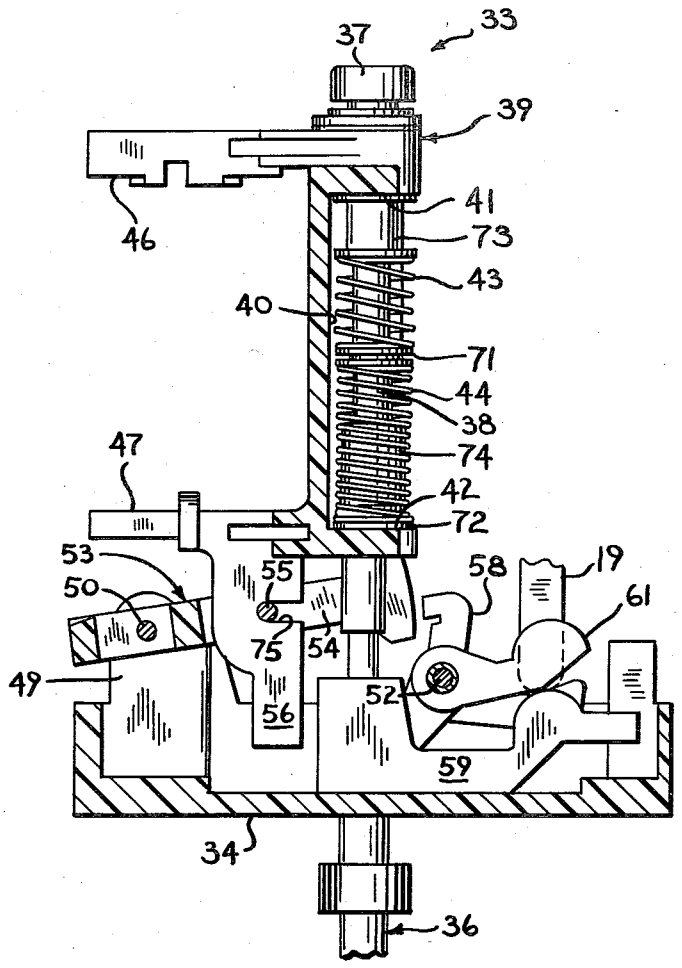
FIG. 6 is a sectional view taken in the plane indicated by lines 6—6 in FIG. 4 to show another view of the timer movement assembly, and a timer hold-down member, in the on delay mode of operation.

The result of this restriction is the loading of the lower spring 44 in the spring cage 40 into a compressed condition as shown in FIG. 6. Within the spring cage 40 the on delay spring 44 and the off delay spring 43 are separated by a spring-compressing flange 71 mounted on and encircling the plunger shaft 38. The flange 71 is fixed on the plunger to be moved therewith. A pair of retaining sleeves 72, 73 are slidably mounted on the shaft 38, the sleeves 72, 73 extending through the lower spring stop 42 and the upper spring stop 41, respectively, and each sleeve having a flange disposed within the spring cage 40. The on delay spring 44 is seated between the flange on the lower retaining sleeve 72 and the lower face of the spring-compressing flange 71. The off delay spring 43 is seated between the flange on the upper retaining sleeve 73 and the upper face of the spring-compressing flange 71. The on delay spring 44 also has a supporting sleeve 74 within its coils to inhibit lateral spring movement.

As the plunger 36 moves on its forward stroke, the on delay spring 44 is stressed by the spring-compressing flange 71 to apply a force to the lower retaining sleeve 72 and the lower spring stop 42. The off delay spring 43 is carried with the shaft 38 in an unstressed, but seated position maintained by the upper retaining sleeve 73, which is picked up by the head 37 of the plunger 36 and moved therewith.

While the on delay catch 57 is restricting the latch 53, the off delay catch 58 is held inoperable by the timer hold-down member 19, as seen in FIG. 6. The off delay finger 61 pivots upward, but it is not in the path of advance of the timer output member 17. The on delay finger 59, which is in the path of advance of the timer output member 17, moves with the plunger 36 away from its blocking position shown in FIG. 5. The output member 17 is freed, and it advances over a time delay period to strike the trigger end 70 of the on delay catch 57 to release the latch 53. The duration of the time delay period was preselected by adjustment of the timer 14. Upon release of the latch 53, the contact actuator 39 moves longitudinally toward the base 34 with spring action to actuate the switch contacts 29 coupled to its links 46, 47. The motion of the contact actuator 39 is longitudinal along the plunger due to a lost motion connection between the actuator stop member 56 and the latch 53. The actuator stop member 56 has a slot 75 which allows the coupling pin 55 to slide laterally, thereby losing the lateral component of the latch motion, while at the same time transmitting the longitudinal component of latch motion. When the electromagnet is deenergized, to have a backward stroke of the plunger 36, the relay movement 33 is returned to the position shown in FIG. 5, with the on delay finger 59 resetting the timer output member 17.

The off delay operation occurs on a backward stroke of the plunger 36, when the associated electromagnet is deenergized to return to its "off" condition. In order to have the time delay relay mechanism of the invention function in the off delay mode, the timer 14 must be reversed in its position to place the bellows 16 and output member 17 in the phantom position shown in FIG. 2. Then, the hold-down member 19 inactivates the on delay catch 57, and the timer output member 17 will function cooperatively with the off delay catch 58 and the off delay finger 61.

Figure 7:
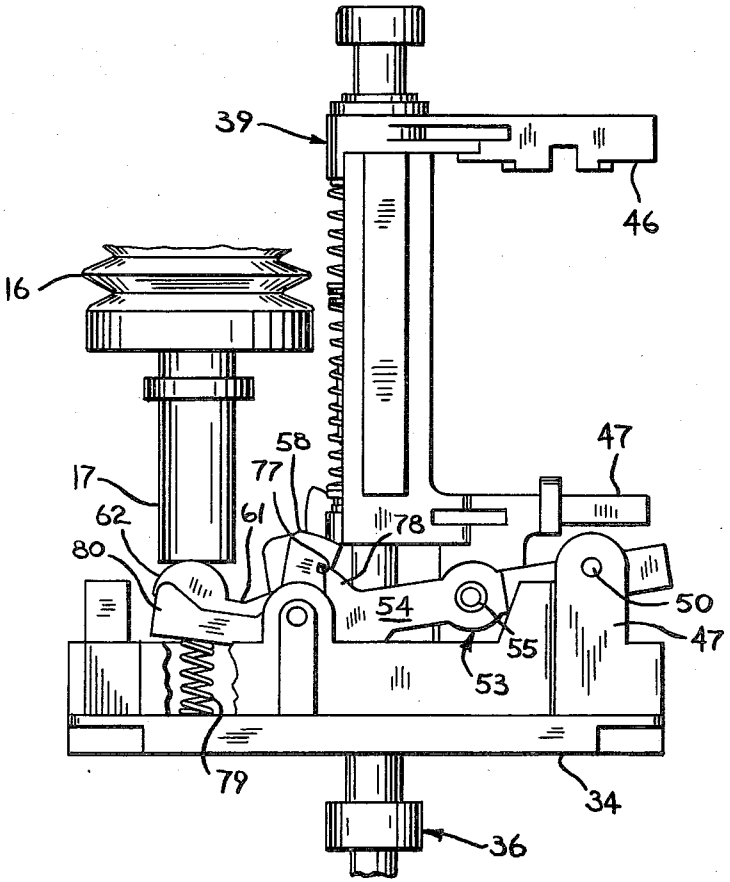
FIG. 7 is a side elevation view of the timer movement assembly of FIG. 4 and the bottom part of the timer, in the off delay mode of operation.

Referring to FIG. 7 the plunger 36 is shown immediately before moving in a backward stroke, or upward as will occur when the electromagnet is deenergized. The off delay finger 61 is held by the plunger 36 in a raised position with its pad 62 blocking the downward advance of the timer output member 17. If the latch were unrestricted, it and the contact actuator would move upward from the base 34 on the plunger backward stroke, but the off delay catch 58 is now operable. On the backward stroke of the plunger 36 a detent 77 on the off delay catch 58 restricts a projection 78 formed on the top surface of the latch arm 54 aligned with off delay catch 58. The off delay catch 58, like its on delay counterpart, is biased in its restricting position by a bias spring 79 located on the base 34 beneath its trigger end 80.

Figure 8:
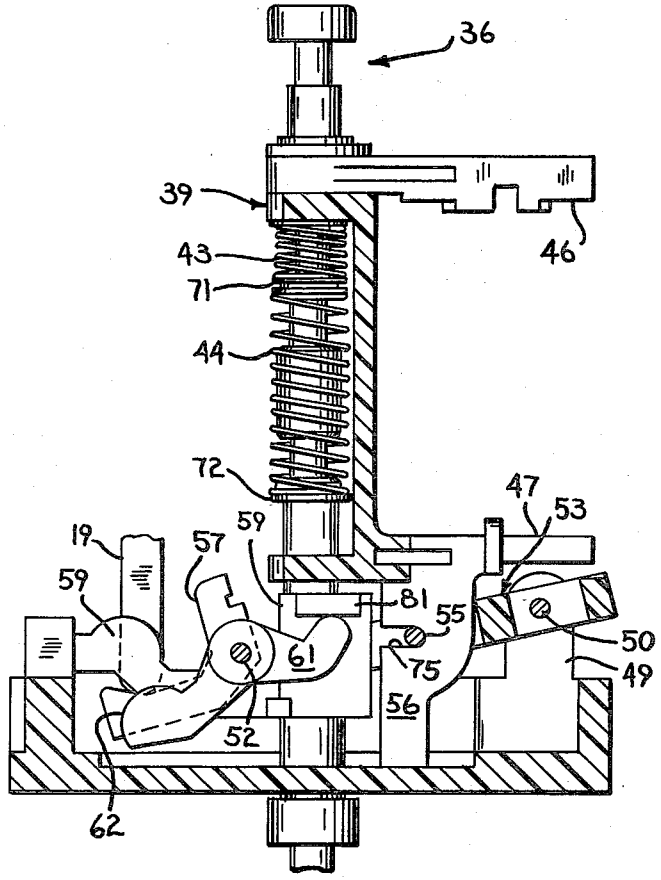
FIG. 8 is a sectional view taken in the plane indicated by lines 8—8 in FIG. 4 to show another view of the timer movement assembly, and the timer hold-down member, in the off delay mode of operation.

The restriction of the latch 53 and its coupled contact actuator 39 results in the loading of the off delay spring 43 by the spring-compressing flange 71, as has occurred in FIG. 8. The on delay spring 44 is carried on the plunger 36 in an unstressed, seated position by the lower retaining sleeve 72, which is picked up by the end of the on delay finger 59 fastened on the plunger 36. This fastened end of the on delay finger 59 has a coupling member 81 projecting from it to operate the off delay finger 61. The off delay finger 61 is unbalanced about the second pivot pin 52 so that its finger pad 62 drops out of its blocking position upon the movement of the coupling member 81 with the plunger 36 on a backward stroke. The timer output member 17 now advances over a time delay period to strike the trigger end 80 of the off delay catch 58 and release the latch 53. The contact actuator 39 is now free to be rapidly moved upward by the loaded spring 43. This causes the links 46, 47 to operate the switch contacts 29 with spring action. During this sequence of operation the on delay finger 59 is out of the path of the advancing timer output member 17, and the on delay catch 57 is held inoperable by the timer hold-down member 19. On the next forward stroke of the plunger 36, the timer output member 17 is reset to its position in FIG. 7 by the movement of the off delay finger 61.

In both the on delay and off delay operations, it is important that the forces applied between the latch 53 and the catches 57, 58 are not so great as to cause accelerated wear on these parts. On the other hand, the springs 43, 44 in the spring cage 40 must be strong enough to operate the switch cartridges 24 with a quick, positive motion. To balance these considerations the latch 53 is arranged with a ratio of approximately 1:2 between the distance from its mounting on the first pivot pin 50 to its coupling with the contact actuator 39, and the distance from its mounting on the first pivot pin 50 to the ends of its latch arms 54. This lever ratio produces forces between the latch arms 54 and the catches 57, 58 that are approximately half of the spring force exerted on the contact actuator 39.

Figure 9:
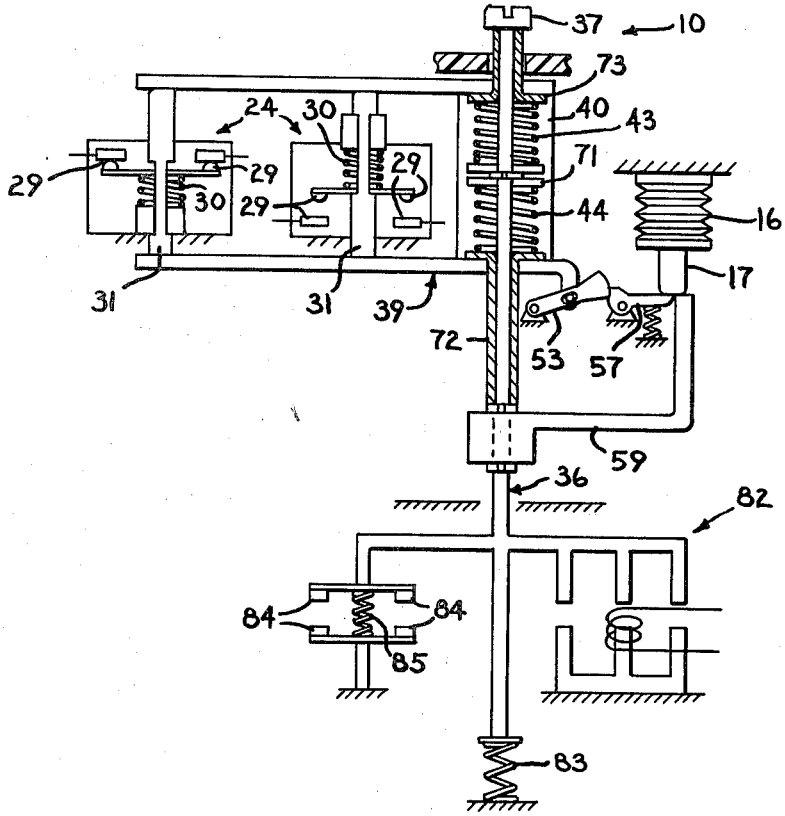
FIG. 9 is a schematic diagram of the time delay relay of FIGS. 1 and 2 shown in the on delay mode of operation with the relay electromagnet deenergized.
Figure 10:
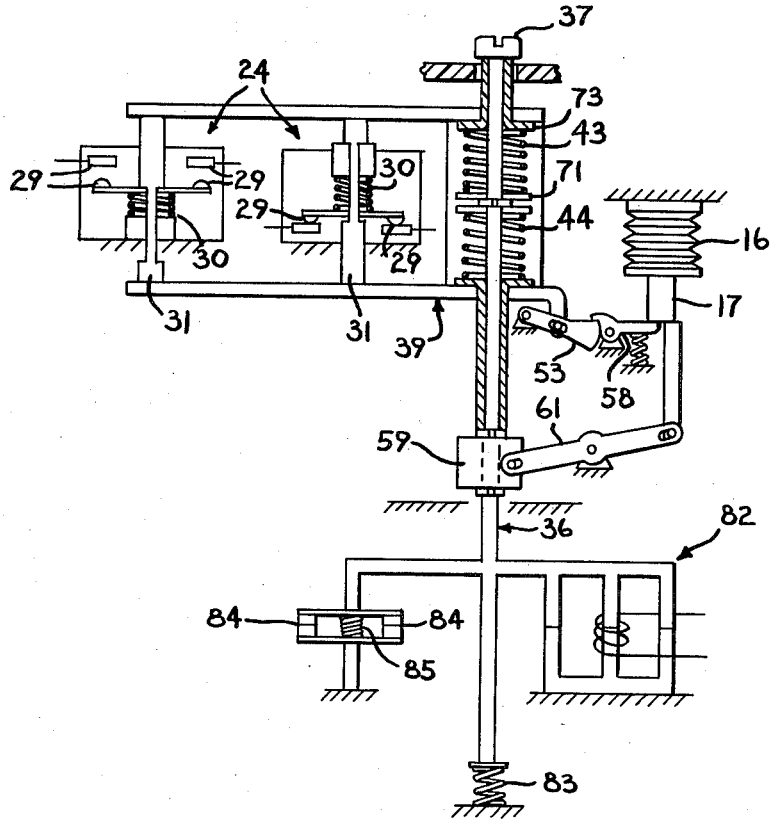
FIG. 10 is another schematic diagram of the time delay relay of FIGS. 1 and 2, shown in the off delay mode of operation with the relay electromagnet energized.

The embodiment of the invention in FIGS. 1–8 is represented schematically in FIGS. 9 and 10. FIG. 9 illustrates operation in the on delay mode while FIG. 10 illustrates operation in the off delay mode, and in each of these two figures there is shown an associated electromagnetic contactor, that had been omitted in FIGS. 1–8. These diagrams illustrate more clearly the operation of the elements within the spring cage 40, and are to be compared with FIGS. 11 and 12, which show an additional embodiment of the invention in the on delay mode and off delay mode, respectively.

Upon the energization of a relay electromagnet 82 in FIG. 9, the forward movement of the plunger 36 pulls the spring-compressing flange 71 against the on delay spring 44. The plunger 36 must move against an armature spring 83 and the on delay spring 44, and must store enough mechanical energy in the on delay spring 44 to compress the time delayed switch contact springs 30 upon release of the contact actuator 39. The plunger 36 must also move instantaneously operating switch contacts 84 against a switch contact spring 85 which is a part of the electromagnetic actuator.

As the plunger 36 moves on its forward stroke, it slides through the lower sleeve 72 which is held in position with the contact actuator 39 by the latching action of the latch 53 and the on delay catch 57. The head 37 of the plunger 36 picks up the upper sleeve 73 and carries the off delay spring 43 in a seated position between the flange of the upper sleeve 73 and the spring-compressing flange 71. The on delay finger 59 moves with the plunger 36, allowing the timer output member 17 to advance and strike the on delay catch 57 as explained previously.

In FIG. 10 the stored mechanical energy in the armature spring 83 and the instantaneously operating switch contact spring 85 aids the compression of the off delay spring 43. The contact springs 30 associated with the time delayed switch contacts 29 have been compressed on the previous forward stroke of the plunger 36 and are ready to be released. Because the spring force required of the off delay spring 43 is less than that required of the on delay spring 44, the off delay spring 43 has a lower rate of compression than the on delay spring 44.

In FIG. 10 the plunger 36 slides through the upper sleeve 73 and moves the spring-compressing flange 71 against the off delay spring 43 on a backward stroke, compressing the off delay spring 43 against the upper sleeve 73 and the latched contact actuator 39. The end of the on delay finger 59 that is fastened to the plunger 36 moves against the lower sleeve 72 to carry the on delay spring 44 in a seated position between the lower sleeve 72 and the spring-compressing flange 71. The off delay finger 61 is coupled to the on delay finger 59 to move away from the timer output member 17 on a backward stroke, allowing it to strike the off delay catch 58 and release the contact actuator 39.

DESCRIPTION OF AN ADDITIONAL EMBODIMENT

Figure 11:
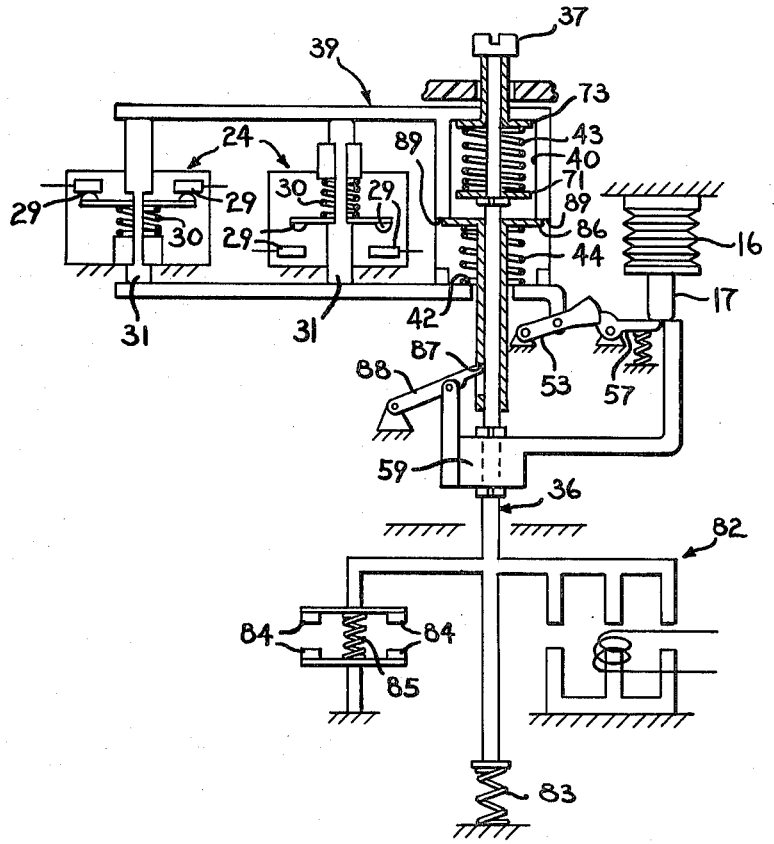
FIG. 11 is a schematic diagram of an alternative embodiment of a time delay relay that incorporates the present invention, shown in the on delay mode of operation with the relay electromagnet deenergized.
Figure 12:
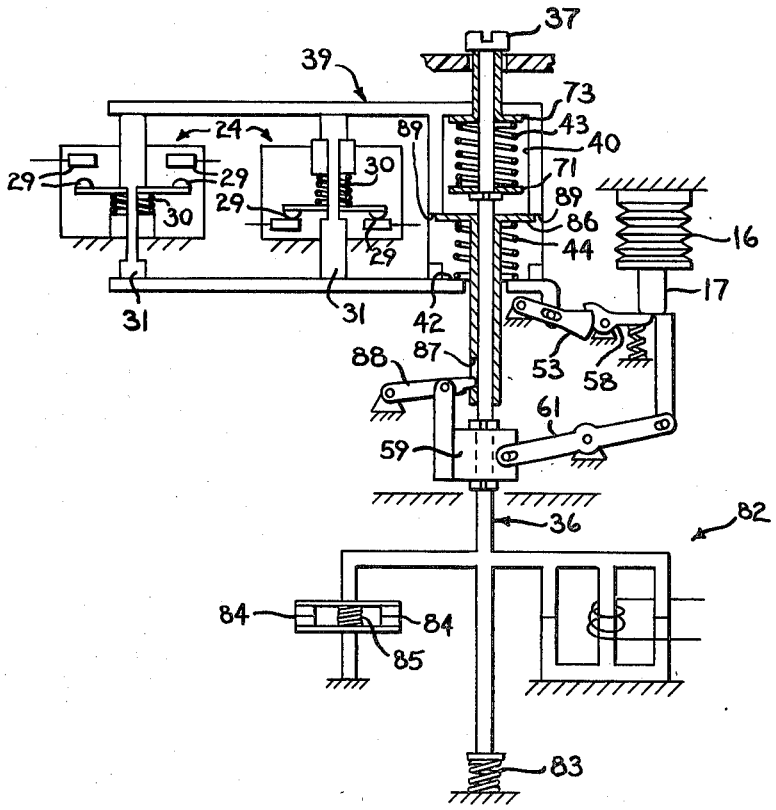
FIG. 12 is a schematic diagram of the same embodiment of the invention as shown in FIG. 11, except that the relay is shown in the off delay mode of operation with the relay electromagnet energized.

In the second embodiment of the invention represented in FIGS. 11 and 12, the arrangement of the spring-stressing means has been altered to reduce the initial spring load to be overcome upon the energization of the relay electromagnet 82. In this embodiment the spring-compressing flange 71 engages and stresses only the off delay spring 43, and cooperates with an upper retaining sleeve 73 to seat the off delay spring 43 on the plunger 36. The on delay spring 44 is compressed by a spring-compressing sleeve 86 that is slidable along the plunger 36, and has a flange spaced apart from the spring-compressing flange 71, and seated against an end of the on delay spring 44. The other end of the on delay spring 44 is seated against the lower spring stop 42. The spring-compressing sleeve 86 extends through the coils of the on delay spring 44 and through the lower spring stop 42 to the outside of the spring cage 40. Its extension outside the spring cage 40 has a notch 87 along part of its length. A pickup member 88 is pivotally connected at one end, and is also pivotally connected between its ends to the on delay finger 59. The free end or tip of the pickup member 88 extends into the notch 87 in the spring-compressing sleeve 86.

In the on delay mode of operation shown in FIG. 11, the tip of the pickup member 88 moves along the length of the notch 87 on a forward stroke on the plunger 36 to engage the spring-compressing sleeve 86, which compresses the on delay spring 44. The spacing between the spring-compressing flange 71 and the flange on the spring-compressing sleeve 86 is at least the length of the notch 87, and the pickup member 88 has a ratio of 1.5:1 between its total length and the length between its two pivot connections. This arrangement allows the pickup member 88 to move along the upper portion of its travel without picking up any load from the on delay spring 44, and to engage the spring-compressing sleeve 86 along the lower portion of its travel and move it the same distance as the plunger 36 moves during the complete stroke. Thus, the lost motion connection between the pickup member 88 and the spring-compressing sleeves 86 delays the pickup of the spring load provided by the on delay spring 44, without changing the length of travel of either the plunger 36 or the spring-stressing means. It will be apparent to those skilled in the art that, in comparison with the first embodiment, this reduction in the initial spring load to be picked up by the electromagnet 82 will reduce the load on the electromagnet during the initial closing movement of the magnet when its pull force is the weakest.

Upon the deenergization of the electromagnet 82 the unlatched contact actuator 39 is moved upward by the spring-compressing flange 71 and the off delay spring 43. The on delay spring 44 carries the spring-compressing sleeve 86 along with its flange seated between the off delay spring 44 on one side, and a pair of abutments 89 formed within the spring cage 40 on the other side. The pickup member 88 rides in the notch 87 without exerting a force on the spring-compressing sleeve 86.

Although it is advantageous to reduce the spring load to be overcome by the relay electromagnet 82 upon its energization, there is no corresponding advantage to reducing the spring load encountered on its deenergization. Therefore, the consideration of spring loads pertains to the forward or energizing stroke of the plunger 36 when the relay is operating in the off delay mode as diagrammed in FIG. 12. The on delay spring 44 is not compressed on the forward stroke of the plunger 36, but the contact springs 30 associated with the time delayed switch contacts 29 present a spring load. The pickup member 88 again delays the engagement of the spring-compressing sleeve 86, which does not compress the on delay spring 44, but pulls it and the contact actuator 39 downward. The contact actuator 39 is moved the same distance as the length of travel of the plunger 36 due to the 1.5:1 ratio associated with the pickup member 88 and explained previously. Again the initial spring load is reduced, but in different measure due to the different compression rate presented by the switch contact springs 30 as compared to the on delay spring 44. On the backward stroke of the plunger 36 the pickup member 88 rides in the notch 87 and does not exert a force on the spring-compressing sleeve 86. The spring-compressing flange 71 stresses the off delay spring 43 and operates the contact actuator 39 in the manner described for the embodiment shown in FIG. 10.

Thus, the invention provides a time delay relay movement that actuates the time delayed switch contacts after either an "on delay" or an "off delay," according to the position of the timer. The contact actuator moves with a linear motion along the operating plunger to insure optimum contact operation. The contact actuator is loaded against a single main actuating spring in either mode of operation in preparation for its time delayed movement. These springs remain seated, whether under stress or not, to further insure smooth operation. The forces applied to the latch and catches have been minimized to prevent wear on these parts. The "on delay" and "off delay" springs have been balanced against the switch contact springs, and in the second embodiment, the spring force to be overcome by the electromagnet upon its energization has been reduced. The relay movement forms an assembly which can be inserted and mounted as a unit in a time delay relay.

I claim:

1. In a relay movement for actuating switch contacts, the combination comprising:

an elongated operating plunger longitudinally movable in forward and backward strokes;

a contact actuator reciprocably movable along said plunger with a pair of spaced spring stops disposed longitudinally of said plunger and adapted to be coupled to said switch contacts to operate the same;

a pair of springs disposed between said spring stops;

spring-stressing means, carried by said plunger between said springs, for loading one of said springs to apply a force against one of said spring stops on a forward stroke of said plunger, and for loading the other of said springs to apply a spring force against the other of said spring stops on a backward stroke of said plunger;

catch means;

a latch coupled to said actuator for movement therewith, said latch being restricted by said catch means upon a movement of the plunger to load one of said springs against said actuator; and a timer adapted to move said catch means after a time delay from the movement of said plunger, thereby releasing said latch to actuate the switch contacts with spring action.

2. The combination of claim 1, wherein the spring-stressing means includes a spring-compressing flange that has opposite faces each engaging a respective one of said springs.

3. The combination of claim 2 further comprising a pair of sleeves slidably mounted on said plunger, each sleeve extending through a respective spring stop, cooperating with said flange to hold a respective spring therebetween, and having an end outside its associated spring stop that is moved with said plunger on one of its strokes to carry the unloaded spring therewith.

4. The combination of claim 1, wherein the spring-stressing means includes a spring-compressing sleeve slidably mounted on said plunger with a flange disposed between said springs, and being adapted to be picked up and moved with said plunger on its forward stroke to load one of said springs, and a spring-compressing flange carried by said plunger between said springs to load the other of said springs on a backward stroke of the plunger.

5. The combination of claim 4 wherein said spring-compressing sleeve has an extension outside one of said spring stops that is adapted to be picked up and moved with said plunger after the plunger has traveled through part of a stroke, thereby delaying the pickup by the plunger of a spring load from a spring stressed by said sleeve and a switch contact spring.

6. The combination of claim 5, further comprising another sleeve slidably mounted on said plunger and extending through the other of said spring stops, cooperating with said flange to hold the other of said springs therebetween, and movable with said plunger on its forward stroke to carry the unloaded spring therewith.

7. In a movement for actuating switch contacts in a time delay relay, the combination comprising:

an operating shaft longitudinally movable in forward and backward strokes;

a contact actuator slidably mounted on said shaft and extending radially from said shaft to a coupled connection with said switch contacts, said actuator having a pair of longitudinally spaced spring stops which encircle said shaft and face one another to form a spring cage therebetween;

a pair of compression springs encircling said shaft and disposed in said spring cage;

a spring-compressing flange, carried by said shaft and positioned between said springs, for loading one of said springs to apply a force against one of said spring stops on a forward stroke of said shaft, and for loading the other of said springs to apply a force against the other of said spring stops on a backward stroke of said shaft; and a latch connected to said actuator for movement therewith;

catch means restraining said latch upon the movement of said shaft to load one of said springs against said actuator; and means for releasing said latch from said catch means after a timed interval.

8. The combination of claim 7, wherein the latch is pivotable and has a lost motion coupling connection with said actuator to transmit longitudinal motion to the actuator along said shaft.

9. The combination of claim 8, wherein the latch has a pivot at one end and a ratio of approximately 1:2 between the distance from its pivot to the actuator coupling, and the distance from its pivot to its restraint by said catch means.

10. In a time delay relay having switch contacts to be operated with a delayed motion, and a timer with an output member than advances along either of two alternate paths during a time delay period, the combination comprising:

an elongated operating plunger longitudinally movable in alternate directions;

a contact actuator coupled to said switch contacts to operate the same, slidable along said plunger in either direction, and having a pair of spaced spring stops disposed longitudinally along said plunger;

a pair of springs disposed between said spring stops;

spring-stressing means disposed between said springs for loading one of said springs to apply a spring force against one of said spring stops upon the movement of the plunger in one direction, and for loading the other of said springs against the other of said spring stops upon the movement of the plunger in the other direction;

a latch coupled to said actuator for movement therewith in either longitudinal direction;

a pair of fingers operated by said plunger in opposite directions along said alternate paths of advancement of said timer output member, each finger moving away from a position blocking the advance of said timer output member upon the spring-loading movement of said plunger in a respective one of said alternate longitudinal directions;

a pair of catches disposed in opposite paths of advance of said timer output member and restricting said latch on opposite spring-loading movements of said plunger; and means for holding one catch inoperable, the other catch being in the selected path of advance of said timer output member to be struck thereby for release of said catch and actuation of said switch contacts.

11. In a time delay relay having switch contacts to be operated with a delayed motion, and a timer with an output member that advances from a reset position at a preselected rate of movement to perform a timing function, the combination comprising:

an operating shaft longitudinally movable in forward and backward strokes;

a contact actuator slidably mounted on said shaft for relative movement with respect thereto that includes a pair of spring stops encircling the shaft that face one another and are spaced longitudinally along said shaft to form a spring cage therebetween, said actuator also extending radially from said shaft to a coupled connection with said switch contacts;

a spring-compressing flange carried by said shaft and positioned between said spring stops;

a pair of compression springs encircling said shaft, one spring being between one of said spring stops and said flange, and the other spring being between the other of said spring stops and said flange, one of said springs being loaded upon the forward stroke of said shaft to apply a force to one of said spring stops, and the other spring being loaded upon the backward stroke of said shaft to apply a force to the other of said spring stops;

a latch coupled to said contact actuator for movement therewith;

finger means blocking said timer output member in its reset position and movable with said shaft upon a stroke thereof away from such blocking position to allow said timer output member to advance; and catch means located in the path of said timer output member that restricts said latch and said contact actuator upon a stroke of said shaft that loads one of said springs, whereby said catch means is struck by said timer output member to release said latch to allow said contact actuator to move in response to a loaded spring for switch contact actuation.

12. The combination of claim 11 further comprising a pair of sleeves slidably mounted on said shaft, each sleeve extending through one of said spring stops with a spring seat in said spring cage and an end outside the cage adapted to be picked up and moved with said shaft; and wherein one spring is held between one of said spring seats and said flange, and the other spring is held between the other of said spring seats and said flange.

13. In a time delay relay having a switch with a contact operator, and a timer with an output member that advances during a time delay period, the combination comprising:

a housing having a timer compartment and a switch compartment, separated by a rib having a longitudinal opening that communicates with said switch compartment, a chamber, and a partition separating said chamber from both compartments, said partition having a passageway extending therethrough from said chamber to said switch compartment; and a relay movement insertably disposed in said chamber, extending longitudinally through said passageway and through said rib opening, extending laterally into said switch compartment from said rib opening, and including:

a. an elongated operating plunger extending longitudinally through said rib opening and movable along a longitudinal axis in forward and backward strokes;

b. a contact actuator slidably mounted on said plunger, extending radially from said plunger to a coupled connection with said contact operator, and having a pair of spaced spring stops disposed longitudinally along said plunger to form a spring cage therebetween that moves reciprocally along said plunger;

c. a pair of springs housed within said spring cage between said spring stops;

d. spring-stressing means carried by said plunger and disposed within said spring cage for loading one of said springs to apply a force against one of said spring stops on the forward stroke of the plunger and for loading the other of said springs to apply a force against the other of said spring stops on the backward stroke of said plunger;

e. a catch means; and f. a latch coupled to said contact actuator for movement therewith, said latch being restricted by said catch means upon the movement of the plunger to load one of said springs against said actuator, and said latch being released by said catch means in response to the advance of said timer output member to actuate the switch contacts.

14. The combination of claim 13, wherein said contact actuator has a pair of longitudinally spaced links extending radially from said plunger to hold said contact operator therebetween, one of said links being movable outside the entrance to said switch compartment, and being pivotable about said axis of the plunger to permit insertion and removal of said switch.

15. The combination of claim 14, wherein:

said housing includes a pair of oppositely disposed longitudinal grooves formed in said rib; and wherein said actuator includes a pair of longitudinal ribs slidably fitting in said grooves to maintain the longitudinal position and prevent rotation of the spring cage.

16. In a time delay relay having switch contacts to be operated with a delayed motion, and a timer with an output member that can be positioned in either of two locations and that advances from a reset position during a time delay period, the combination comprising:

an elongated operating plunger longitudinally movable in forward and backward strokes;

a base that surrounds said plunger and has a first pair of spaced supports with a first pivot pin therebetween on one side of the plunger, and a second pair of spaced supports with a second pivot pin therebetween on the other side of the plunger;

a latch pivotally mounted on said first pivot pin with a pair of arms extending toward the second pair of supports;

a switch actuator, coupling said switch contacts with said latch, and slidably mounted on said plunger with a pair of spring stops disposed longitudinally along said plunger;

a pair of springs disposed between said spring stops;

spring stressing means carried by said plunger for loading a respective spring upon the latching of the switch actuator on either a forward or backward stroke of said plunger;

an "On Delay" finger connected to said plunger and movable away from a position blocking the advance of said timer output member in its first location on a forward stroke of the plunger;

an "Off Delay" finger pivotally mounted on said second pivot pin, and held by said plunger in a position blocking the advance of said timer output member in its second location, said second finger being released from its blocking position upon a backward stroke of said plunger;

a pair of catches pivotally mounted on said second pivot pin, each restricting a respective latch arm on opposite strokes of said plunger until struck by said timer output member, including an "On Delay" catch being disposed with said "On Delay" finger in the path of said advancing timer output member in its first location, and an "Off Delay" catch being disposed with said "Off Delay" finger in the path of said advancing timer output member in its second location; and means for holding one catch inoperable while said timer output member advances to strike the other catch, thereby releasing the latch to operate the switch contacts.

* * * * *